US011161643B2

(12) United States Patent
Aziz

(10) Patent No.: US 11,161,643 B2
(45) Date of Patent: Nov. 2, 2021

(54) INTERLOCKING STACKABLE CONTAINERS

(71) Applicant: Jan Aziz, Fort Worth, TX (US)

(72) Inventor: Jan Aziz, Fort Worth, TX (US)

( * ) Notice: Subject to any disclaimer, the term of this patent is extended or adjusted under 35 U.S.C. 154(b) by 0 days.

(21) Appl. No.: 15/996,277

(22) Filed: Jun. 1, 2018

(65) Prior Publication Data

US 2019/0367206 A1 Dec. 5, 2019

Related U.S. Application Data

(60) Provisional application No. 62/513,676, filed on Jun. 1, 2017.

(51) Int. Cl.

| | |
|---|---|
| ***B65D 5/00*** | (2006.01) |
| ***B65D 5/22*** | (2006.01) |
| *B31B 50/26* | (2017.01) |
| *B31B 120/30* | (2017.01) |
| *B31B 50/20* | (2017.01) |
| *B31B 100/00* | (2017.01) |
| *B31B 110/35* | (2017.01) |
| *B31B 50/25* | (2017.01) |

(52) U.S. Cl.

CPC ..... *B65D 5/0015* (2013.01); *B65D 5/22* (2013.01); *B31B 50/20* (2017.08); *B31B 50/25* (2017.08); *B31B 50/26* (2017.08); *B31B 2100/002* (2017.08); *B31B 2110/35* (2017.08); *B31B 2120/302* (2017.08)

(58) Field of Classification Search

CPC ..... B65D 5/0015; B65D 5/22; B65D 5/0035; B65D 85/34

USPC ..... 229/117.04, 178, 915, 916, 919, 169, 229/149, 117.17, 122.32, 195; 206/509, 206/511, 557

See application file for complete search history.

(56) References Cited

U.S. PATENT DOCUMENTS

| | | | | |
|---|---|---|---|---|
| 4,356,952 A * | 11/1982 | Rekow | B65D 5/0035 206/511 |
| 5,263,635 A * | 11/1993 | Fitzgerald | B65D 5/6664 206/45.29 |
| 5,494,214 A * | 2/1996 | Fleury | B65D 5/6664 229/114 |
| 5,535,942 A * | 7/1996 | Vilona | B65D 5/0035 229/122.32 |
| 5,967,407 A * | 10/1999 | Mueller | B65D 5/22 229/125.19 |
| 6,116,498 A * | 9/2000 | Sheffer | B65D 5/0035 229/114 |
| 6,502,698 B1 * | 1/2003 | McKenna | B65D 5/0015 206/509 |
| 6,889,893 B2 * | 5/2005 | Kent | B65D 5/0015 229/120 |

(Continued)

*Primary Examiner* — Christopher R Demeree
(74) *Attorney, Agent, or Firm* — Andrew Morabito

(57) ABSTRACT

An interlocking container formed from one piece of material, comprising, a base panel having a first, second, third, and forth edge; a first side foldably connected along a first edge to the first edge of the base panel, a second side foldably connected along a first edge to the second edge of the base panel, a third side is foldably connected along a first edge to the third edge of the base panel, a fourth side is foldably connected along the a edge to the fourth edge of the base panel, wherein when folded a container with interlocking tabs is formed.

12 Claims, 6 Drawing Sheets

(56) References Cited

U.S. PATENT DOCUMENTS

| | | | | |
|---|---|---|---|---|
| 8,567,661 | B2 * | 10/2013 | Sullivan | B65D 5/48048 229/120.24 |
| 2007/0051789 | A1 * | 3/2007 | Panduro, Jr. | B65D 5/6629 229/175 |
| 2011/0272455 | A1 * | 11/2011 | Robinson, III | B62B 3/006 229/5.5 |
| 2012/0153013 | A1 * | 6/2012 | Covelli | B65D 5/0015 229/100 |
| 2013/0240614 | A1 * | 9/2013 | Perron | B65D 5/3607 229/117.01 |
| 2016/0347498 | A1 * | 12/2016 | Lambert | B65D 5/6652 |

* cited by examiner

INTERLOCKING STACKABLE CONTAINERS

This utility patent application claims the benefit of the provisional patent application 62/512,676 filed on Jun. 1, 2017.

BACKGROUND OF THE INVENTION

The present invention relates to stackable containers preferably made of corrugated cardboard, and more particularly to containers formed from a single piece of material that can be manually folded to form a stackable container for holding various items, and the containers have an integrated interlocking mechanism to reduce side to side and forwards and backwards movement.

Stackable containers for stable storage of articles, such as ornaments, are known in the art and are being used with increasing frequency because of the low cost, convenient flat storage ability until needed, sufficient strength and durability, and low weight. It would be desirable to have a stackable container formed of a single piece of material that would interlock with another similar container to permit vertical stacking of a number of containers while maintaining sufficient strength and ease of use. It would further be desirable for such a container to have the interlocking mechanism to be positioned for easy visibility and reduce forwards, backwards, and side to side movement.

SUMMARY

Accordingly, it is an objective of the present invention to provide a foldable container which has an aligning interlocking design to assist with stacking the containers, and also securing the container in place once stacked.

Accordingly, the present invention, is an interlocking container formed from one piece of material, comprising: a base panel having a first, second, third, and forth edge; a first side comprising, a first panel having a first, second, third and fourth edge, wherein the first panel is foldably connected along the first edge to the first edge of the base panel, a second panel having a first, second, third, and fourth edge, wherein a first notch is formed along the second edge, a second notch is formed along the third and forth edges, and the first edge foldably connected to the second edge of the first panel, and a third panel having a first, second, third, and fourth edge, wherein a third notch is formed along the second edge, a fourth notch is formed along the third and forth edges, and the first edge foldably connected to the second edge of the first panel; a second side comprising, a first panel having a first, second, third and fourth edge, wherein the first panel is foldably connected along the first edge to the second edge of the base panel, a second panel having a first, second, third, and fourth edge, wherein a first notch is formed along the second edge, a second notch is formed along the third and forth edges, and the first edge foldably connected to the second edge of the first panel, and a third panel having a first, second, third, and fourth edge, wherein a third notch is formed along the second edge, a fourth notch is formed along the third and forth edges, and the first edge foldably connected to the second edge of the first panel; a first end comprising, a first panel having a first, second, third, and fourth edge, where the first panel is foldably connected along the first edge to the third edge of the base panel, wherein along the foldably connected first edge at least one tab cut along the second edge of the first panel, and a second panel having a first, second, third, and fourth edge, wherein the second panel is foldably connected along the first edge to the second edge of the first panel, and a third panel having a first, second, third, and fourth edge, wherein the third panel is foldably connected along the first edge to the second edge of the second panel, and at least one tab is incorporated into the second edge of the third panel; a second end comprising, a first panel having a first, second, third, and fourth edge, where the first panel is foldably connected along the first edge to the fourth edge of the base panel, wherein along the foldably connected first edge at least one tab cut along the second edge of the first panel, and a second panel having a first, second, third, and fourth edge, wherein the second panel is foldably connected along the first edge to the second edge of the first panel, and a third panel having a first, second, third, and fourth edge, wherein the third panel is foldably connected along the first edge to the second edge of the second panel, and at least one tab extending from the second edge of the third panel.

DETAILED DESCRIPTION OF THE INVENTION

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. It is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, the preferred methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present invention is not entitled to antedate such publication by virtue of prior invention. Further, the dates of publication provided may be different from the actual publication dates which may need to be independently confirmed.

It must be noted that as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements or use of a "negative" limitation.

Figure 1:
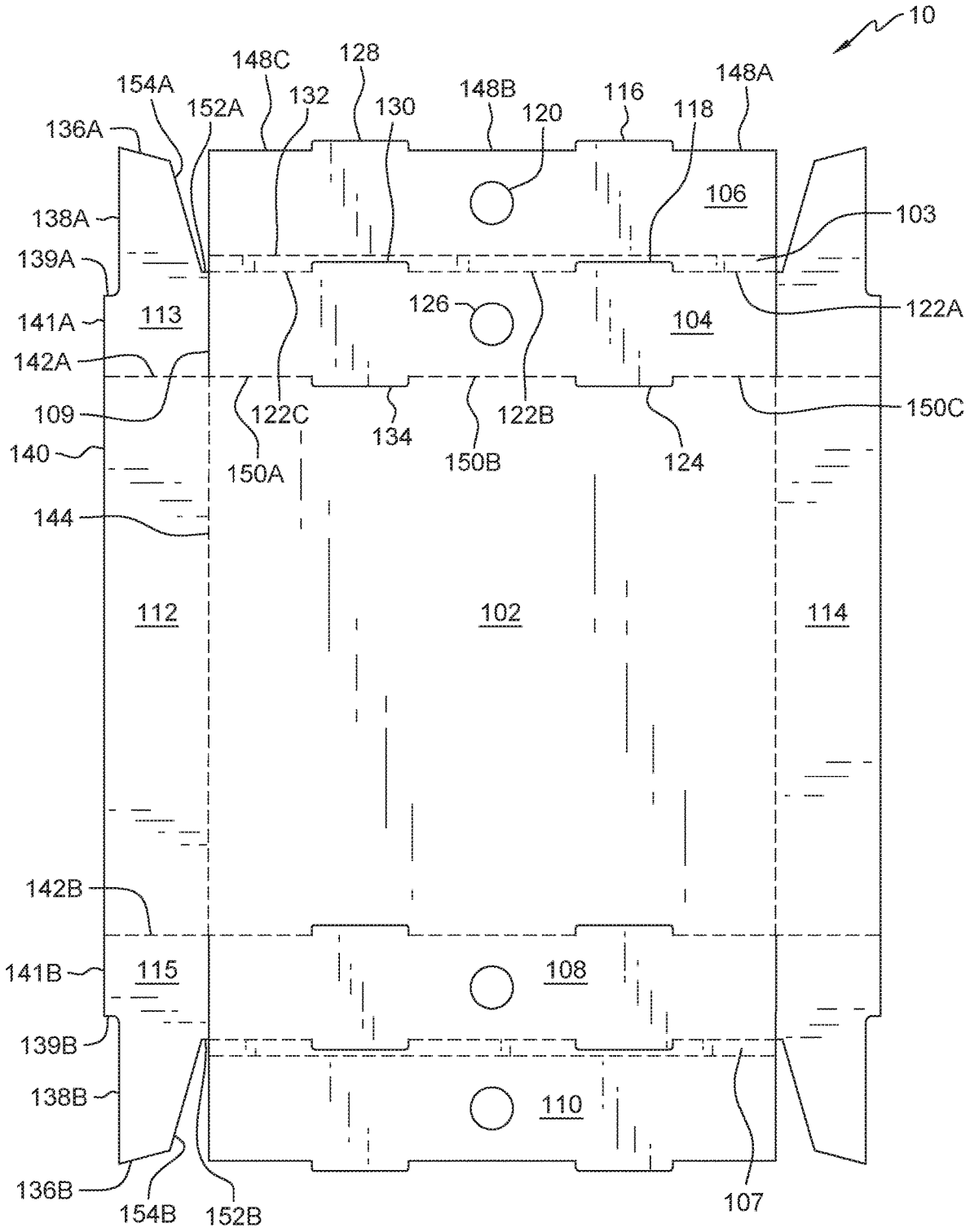
FIG. 1 depicts an isometric view of a stackable container, in accordance with one embodiment of the present invention.
Figure 2:
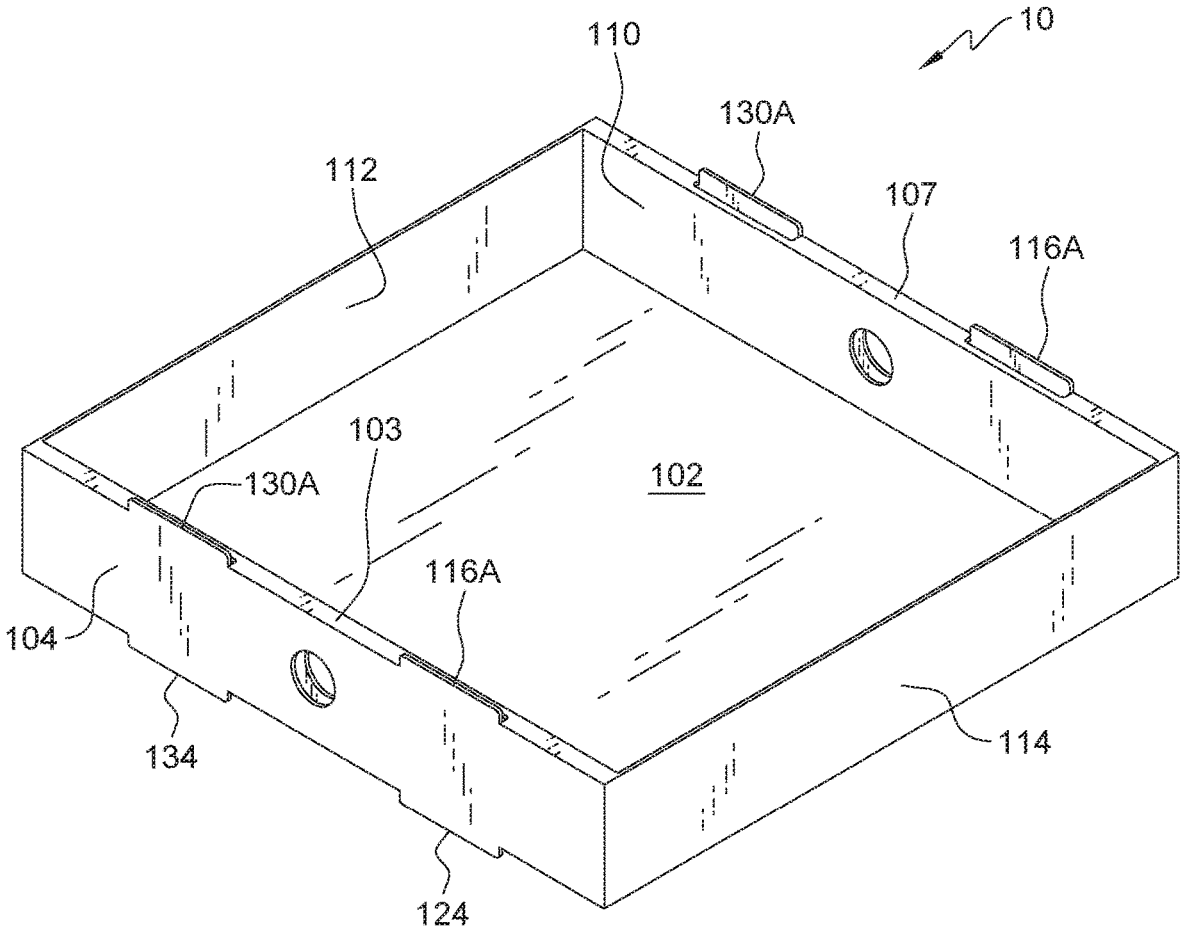
FIG. 2 depicts a top view of the stackable container, in accordance with one embodiment of the present invention.
Figure 3:
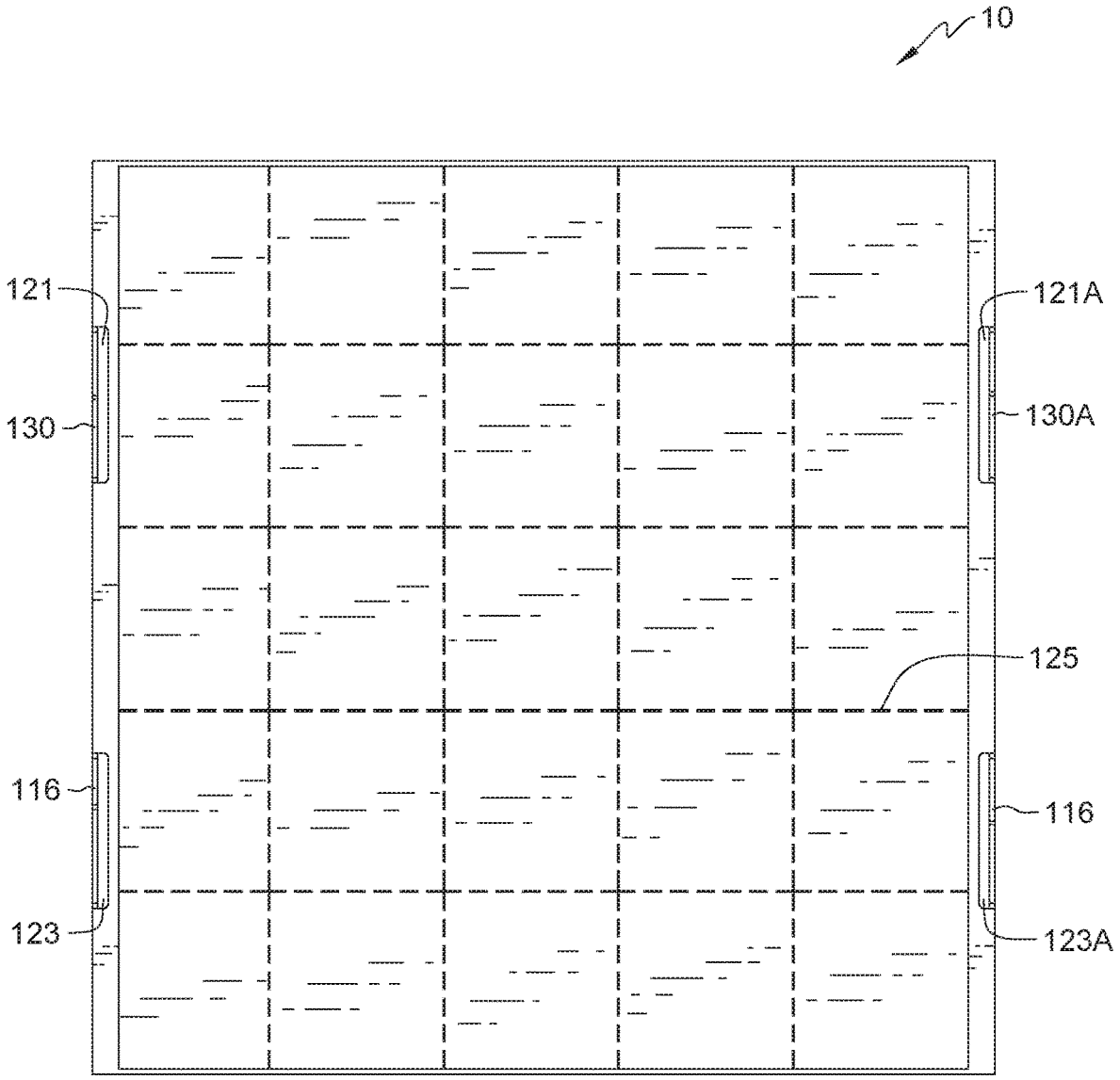
FIG. 3 depicts a bottom view of the stackable container, in accordance with one embodiment of the present invention.
Figure 4:
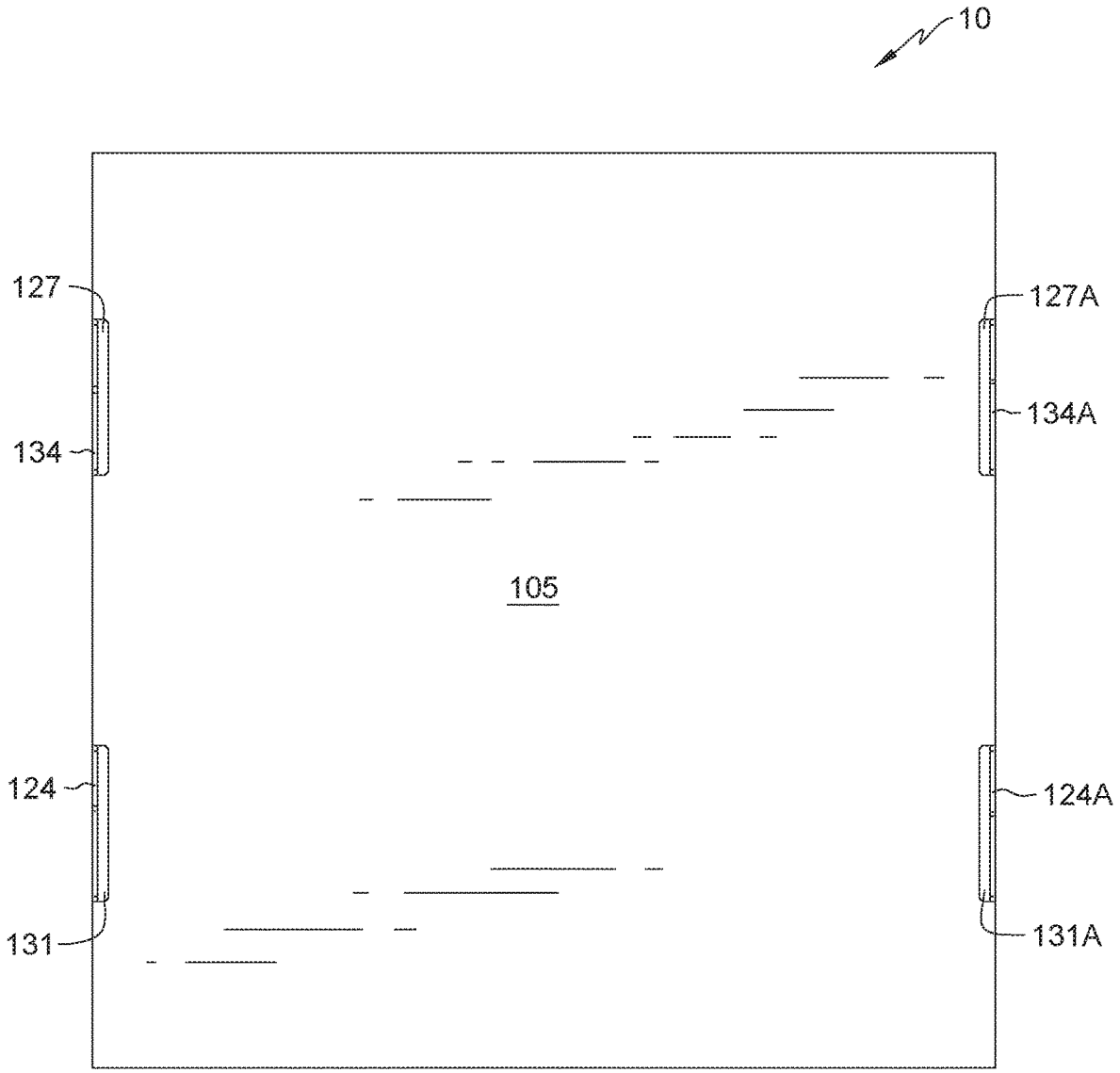
FIG. 4 depicts a front view of the stackable container, in accordance with one embodiment of the present invention.
Figure 5:
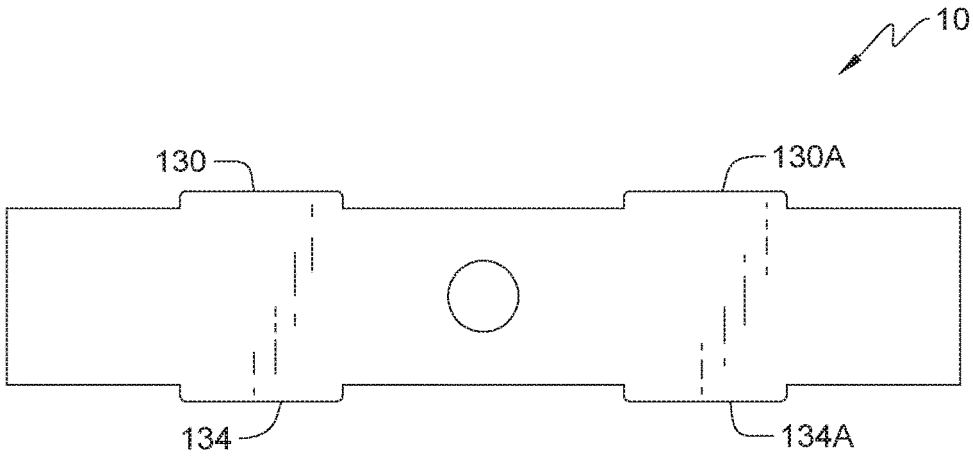
FIG. 5 depicts a side view of the stackable container, in accordance with one embodiment of the present invention.
Figure 6:
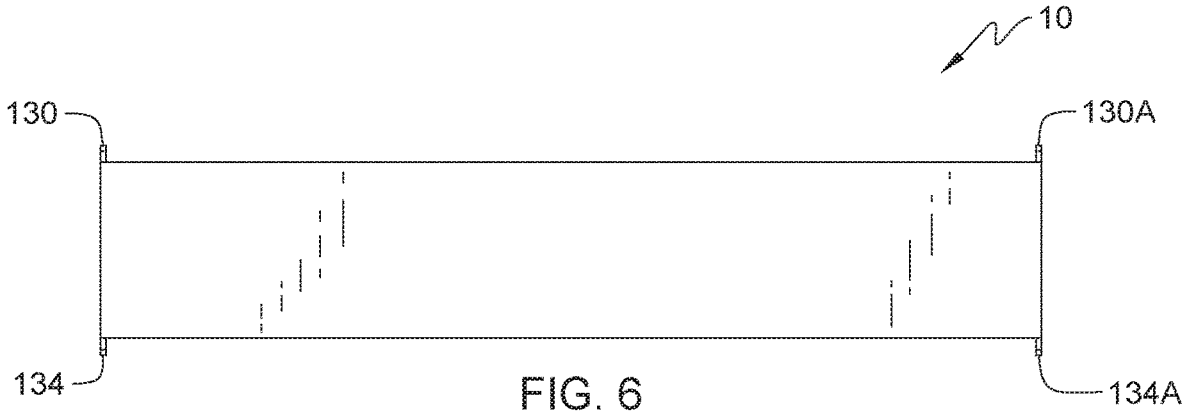
FIG. 6 depicts an isometric view of a pair of the stackable container interlocked, in accordance with one embodiment of the present invention.

FIG. 1 depicts a top view of an unfolded stackable container, in accordance with one embodiment of the present invention. The sheet 100 has a bottom panel 102 attached to a first side panel 112, a second side panel 114, a first end panel 104, and a second end panel 108 along scored lines. The first end panel 104 is connected to a top panel 103, which is connected to a second end panel 106 and the second end panel 108 is connected to a top panel 107, which is connected to a second end panel 110 along scored lines. Side 112 is construction to be substantially similar to that of side 114, and the first end panel 104, top panel 103, and the second end panel 106 are constructed to be substantially similar to that of second end panel 108, top panel 107, and second end panel 110. For this embodiment, side panel 112 and the first end panel 104 and the second end panel 106 will be described and the reciprocal panels will have similar constructions.

The bottom panel 102 is connected to side panel 112 by score line 144 and the first end panel 104 is connected to the first end panel 104 by score line 150 (sections 150A, 150B, and 150C), wherein the score line 150 has tabs 134 and 124. Panels 112, 104, 106, 108, 110, and 114 are substantially the same height, so that when the container is formed, the container has equal height sides.

Side panel 112 has a first extension 113 and a second extension 115 connected to the side panel along scored lines 142A and 142B respectively. In the depicted embodiment, the first extension 113 and the second extension 115 are substantially similar in shape, size, and dimensions. In additional embodiments, the first extension 113 and the second extension 115 may vary.

The first extension 113 has a top edge 141A which extends a predetermined distance until, top edge 141A terminates and end 139A extends perpendicular to top edge 141A. End 139A is substantially the same length as tab 134 height and preferably a shape substantially mirroring the corner edge of tab 134. End 139A terminates at edge 138A, which extends a distance greater than that of the length of tab 134, at which the edge 138A terminates to end 136A. Edge 138A becomes a surface for which a second container tabs rest upon when inserted into the opens. End 136A terminates at inside edge 154A, which extends a predetermined distance towards score line 122, wherein end 136A terminates to inside edge 154A. In the depicted embodiment, end 154A terminates at score line 122. The length of edge 152A is substantially similar to the height of tab 134. The first extension 113 and the first side panel 104 are separated along edge 109.

The first end panel 104 has tabs 134 and 124 separating score line 150. A second score line 122 (comprised of sections 112A, 122B, and 122C) connects the first end panel 104 to the top panel 103. Along score line 122 are tabs 130 and 118. The shape and position of tab 130 substantially aligns with that of tab 134 relative to edge 109. The shape and position of tab 118 substantially aligns with that of tab 124 relative to edge 109.

The top panel 103 is connected to the second end panel 106 along score line 132. The space between score line 122 and 148 is substantially the thickness of sheet 100. The second end panel 106 has tabs 128 and 116 extending from edge 148 (comprised of sections 148A, 148B, and 148C) a predetermined distance. Tab 128 is substantially the same shape, size, and is aligned with tab 130 relative to edge 109, and tab 116 is substantially the same shape, size, and is aligned with that of tab 118 relative to edge 109. Tab 128, tabs 130 and 134 are substantially the same shape and aligned, and tab 116 and tabs 118 and 124 are substantially the same shape and aligned, so that when the container 10 is constructed, the edges align and the tabs fit within the openings which are formed at the tabs.

Holding openings 120 and 126 are used for carrying the container 10 when constructed and are positioned so when the first end panel 104 and the second end panel 106 are folded, the tabs align.

The scored lines, may be, but not limited to creased lines, perforated lines, or prefolded lines to allow for easy visual reference to where the sheet 100 is designed to be folded along to construct the container 10. It is to be understood that the tab could is meant to include a, notch, space, either angled, rounded, curved, or the like having a regular or irregular geometry.

FIGS. 2-6 shows one exemplary embodiment of the present invention in which a stackable container 10 is formed from the sheet 100. The material can be made of any suitable material known to those skilled in the art or developed hereafter, such as, but not limited to, paperboard, paper, cardboard, plastic corrugated material, plastic, wood, ceramic, composite, mixtures thereof and the like. The material can be plain, coated or otherwise treated. The material is preferably corrugated paperboard. The material may be single wall, double wall or multiple wall construction. The panels forming the container, as described below, may be solid or have holes therein for reducing weight, providing ventilation and/or for other purposes.

Divider 125 may be various types of dividers known to those in the art which are used with cardboard or corrugated boxes. In some embodiments, the divider 125 is intended to be fitted folded into the container 10. The divider 125 is inserted into the container 10. Various shapes, sizes, and types of dividers 125 may be used. In the depicted embodiment, the divider is shown in a dashed line as to delineate the divider 125 from the container 10.

The stackable container 10 is assembled by folding the panels described in an exemplary, but non-limiting manner. It is to be understood by those skilled in the art that the sequence and/order of panel folding may be modified as desired. The first end panel 106 is folded over so that tab 130 and 116 are exposed and form tabs extending beyond top surface 103. Through the creation of the tabs 130 and 116, an opening along top surface 103 is created. Opening 121 is created where tab 130 is formed, and opening 123 is created where tab 116 is created. The openings are substantially the same thickness as the sheet 100. In the depicted embodiment, the tabs 130 and 116 are formed along the outer surface of the container 10 and the openings 121 and 123 are formed towards the interior of the container 10. Along the bottom edge of first end panel 104, tab 134 and 124 form tabs extending downwards. Openings 127 and 131 are formed similar to those on the top edge 103, but on the bottom surface 105. Openings 121 and 127 are substantially aligned along with the tabs created at each opening, and openings 123 and 131 substantially align along with the tabs which are created when the sheet 100 is folded to form the container 10.

The tabs 134, 130, 128, 116, 118, and 124 for stacking may vary in shape as may be dictated by considerations of aesthetics, economics, or function. In some embodiment the tabs may be generally rectangular, or even have a decorative shape to add interest.

In the depicted embodiment, the tabs 134, 130, 128, 116, 118, and 124 are substantially the same shape, and the shape is a plateau or a trapezoidal shape, with the shape having a horizontal width at the base the same width as the top of the tab. There is no fold or crease at the base of the tabs, so when the container 10 is created, the tabs 134, 130, 128, 116, 118, and 124 remain unbent and protrude unbent in their respective directions. The corners of the tabs 134, 130, 128, 116, 118, and 124 may be sharp corners or rounded corners.

Though the score lines 122 and 150 the vertical and horizontal portions of the tabs are formed by cutting a portion from the respective panel of the score lines 122 and 150. The tabs 130, 118, 134, and 124 are formed by a cut with the first vertical cut beginning at the respective score line then extending in the respective direction as shown in FIG. 1, then extending horizontally, and then extending back towards the score line. The bases of the tabs have been integrally formed with the first end panel 104, and remain attached to first end panel 104 when the container 10 is folded. The similar process is performed with the tabs integrated with second end panel 108, and also with the first top panel 106 and the second top panel 110.

Figure 7:
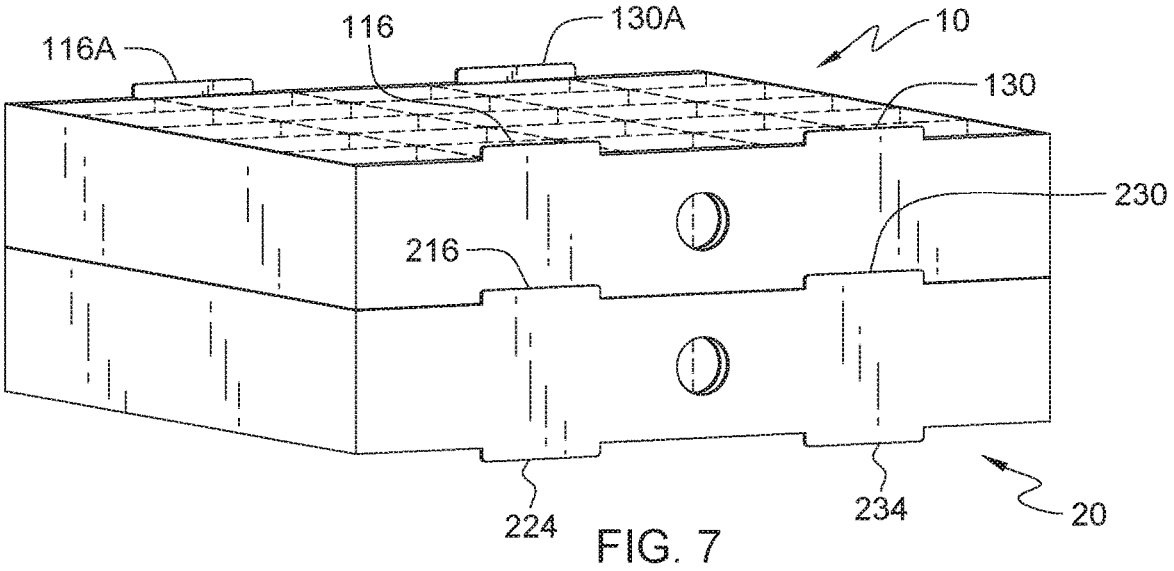
FIG. 7 depicts an isometric view of the pair of the stackable container detached, in accordance with one embodiment of the present invention.
Figure 8:
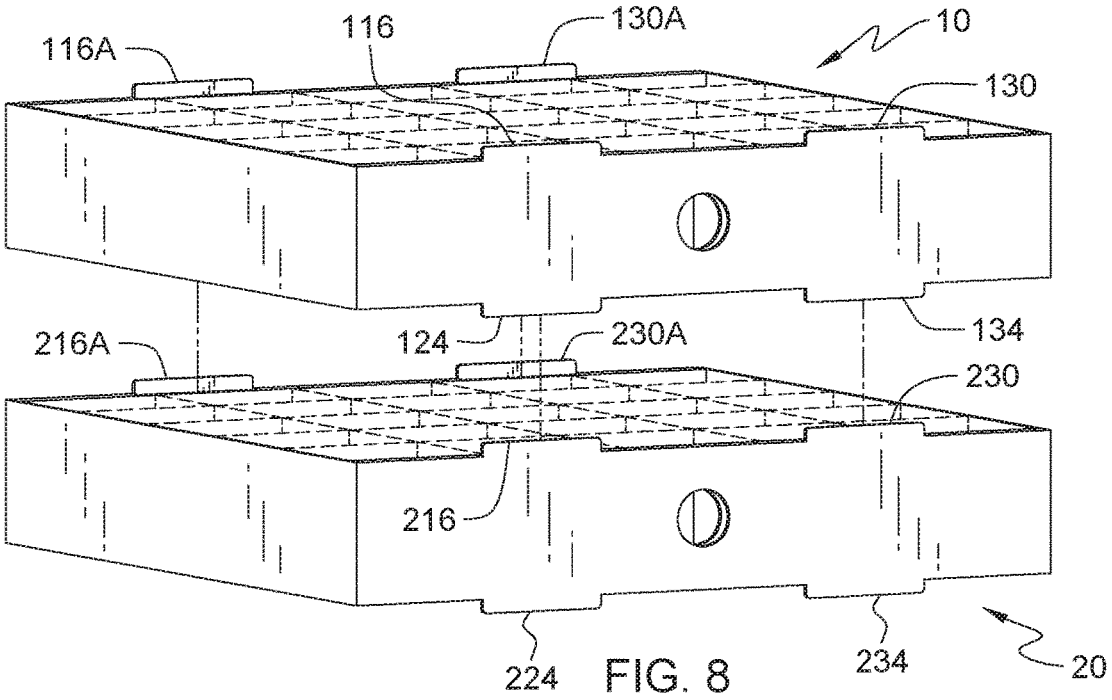
FIG. 8 depicts a top view of an isometric view of a pair of the stackable container interlocked, in accordance with one embodiment of the present invention.

FIGS. 7 and 8, show how two containers 10 and 20 use the tabs and openings to interlock with one another. As containers 10 and 20 are substantially mirror images in terms of design and dimensions, the openings and tabs align, and the tabs fit within the corresponding opening. In the depicted embodiment, the tabs 124, and 134 on container 10 aligns with the tabs 216 and 230 respectively, and the tabs on container 10 fit within the openings situated behind the tabs 216 and 230 on container 20. This method of interlocking the two containers secures them from moving in a side to side and forwards or backwards directions. Internally, the extensions 113 and 115 provide a base for the tabs to rest on. If, in some embodiments, a gap was desired between containers, the extensions 113 and 115 would provide a set distance in which the tabs can extend into the other container. This is beneficial is circulation between the internal compartment of the containers is desired.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. It should further be noted that any patents, applications and publications referred to herein are incorporated by reference in their entirety.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

What is claimed is:

1. An interlocking container formed from one piece of material, comprising:

a base panel having a first, second, third, and forth edge;

a first end wall extending from the first edge of the base panel, wherein the first end wall is comprised of an inner and outer panel foldably connected along a score line, and at least two tabs extend from the first edge and at least two tabs extend from the score line, and wherein the at least two tabs on the first edge are equally spaced and the at least two tabs on the score line align with the at least two tabs on the first edge;

a second end wall extending from the second edge of the base panel, wherein the second end wall is comprised of an inner and outer panel foldably connected along a score line, and at least two tabs extend from the first edge and at least two tabs extend from the score line, and wherein the at least two tabs on the first edge are equally spaced and the at least two tabs on the score line align with the at least two tabs on the first edge;

a first side wall, extending from the third edge of the base panel, wherein the first end wall has an extension sized to fit between the inner and out panels of the first and second end walls;

a second end wall, extending from the fourth edge of the base, wherein the first end wall has an extension sized to fit between the inner and out panels of the first and second end walls, and wherein the extensions have an upper and lower cutout, wherein the upper and lower cutout is sized based on the tabs of the first and second end walls; and a divider sized to fit within the formed container, wherein the divider interacts with the first and second side walls and the first and second end walls.

2. The interlocking container of claim 1, wherein, the interlocking container is formed from a single sheet of corrugated material.

3. The interlocking container of claim 1, where the at least two tabs extend from the first edge of the first and second end walls-are substantially aligned to receive the at least two tabs on the second edge of the first and second end walls of another interlocking container.

4. The interlocking container formed from one piece of material of claim 1, wherein the tabs are spaced relative to a center line.

5. The interlocking container formed from one piece of material of claim 1, wherein the outer panel has at least two tabs extending from an exterior edge, wherein the tabs are substantially aligned with the tabs on the score line.

6. The interlocking container formed from one piece of material of claim 5, wherein openings are formed when the first and second end walls are folded along the base panel edge and are sized to fit the tab extending from the outer panels.

7. An interlocking container formed from one piece of material, comprising:

a base panel having a first, second, third, and forth edge;

a first end wall having a first edge and a second edge and extending from the first edge of the base panel, wherein two tabs extend from the first edge and two tabs extend from the second edge and when the first end wall is folded along the first edge a slot is formed and the two tabs on the second edge align with the slots on the first edge;

a second end wall having a first edge and a second edge and extending from the second edge of the base panel, wherein two tabs extend from the first edge and two tabs extend from the second edge and when the first end wall is folded along the first edge a slot is formed and the two tabs on the second edge align with the slots on the first;

first side wall having first extension and a second extension, extending from the third edge of the base panel, and wherein the first extension and the second extension have profiles based on the profile of the tabs; and a second side wall, having first extension and a second extension extending from the fourth edge of the base, and wherein the first extension and the second extension have profiles based on the profile of the tabs.

8. The interlocking container formed from one piece of material of claim 7, wherein the tabs on the first end wall and the second end wall are substantially the same shape and dimensions.

9. The interlocking container formed from one piece of material of claim 8, wherein the tabs have a substantially trapezoidal shape.

10. The interlocking container formed from one piece of material of claim 7, wherein the two tables of the first edge and the second edge of the first and second end walls are substantially the same distance from a center line of the base plate.

11. The interlocking container formed from one piece of material of claim 7, wherein the first and second extensions of the first and second side walls have a trapezoidal shape.

12. The interlocking container formed from one piece of material of claim 7, wherein the first and second extensions of the first and second side walls have an upper cutout and a lower cutout wherein the upper cutout is substantially similar to a profile of the tabs extending from the first edge and the lower cutout is substantially similar to the profile of the tabs extending from the second edge.

* * * * *